US006682383B2

(12) United States Patent
Cho et al.

(10) Patent No.: US 6,682,383 B2
(45) Date of Patent: Jan. 27, 2004

(54) CATHODE STRUCTURE FOR FIELD EMISSION DEVICE AND METHOD OF FABRICATING THE SAME

(75) Inventors: Young-Rae Cho, Taejon (KR); Jin-Ho Lee, Taejon (KR); Yoon-Ho Song, Taejon (KR); Seung-Youl Kang, Taejon (KR); Moon-Youn Jung, Seoul (KR); Kyoung-Ik Cho, Taejon (KR); Do-Hyung Kim, Ulsan (KR); Chi-Sun Hwang, Taejon (KR)

(73) Assignee: Electronics and Telecommunications Research Institute, Taejon (KR)

( * ) Notice: Subject to any disclaimer, the term of this patent is extended or adjusted under 35 U.S.C. 154(b) by 268 days.

(21) Appl. No.: 09/860,397

(22) Filed: May 17, 2001

(65) Prior Publication Data

US 2001/0044251 A1 Nov. 22, 2001

(30) Foreign Application Priority Data

May 17, 2000 (KR) ..... 2000-26389
Nov. 30, 2000 (KR) ..... 2000-72037

(51) Int. Cl.[7] ..... H01J 1/304; H01J 9/02
(52) U.S. Cl. ..... 445/50; 445/24; 438/20
(58) Field of Search ..... 445/24, 25, 50, 445/51; 313/309, 336, 351, 495; 438/20

(56) References Cited

U.S. PATENT DOCUMENTS 5,623,180 A 4/1997 Jin et al. ..... 313/310
5,900,301 A 5/1999 Brandes et al. ..... 428/77
5,948,465 A 9/1999 Blanchet-Fincher et al. .. 427/77

*Primary Examiner*—Kenneth J. Ramsey
*Assistant Examiner*—Joseph Williams
(74) *Attorney, Agent, or Firm*—Seed IP Law Group PLLC

(57) ABSTRACT

A cathode structure for a field emission device, which is an essential component of a field emission device, and a method of fabricating the same are provided. An emitter material for electron emission constituting cathodes is formed in a particulate emitter, the particulate emitter is formed of a material from which electrons can be easily emitted at a low electric field. A significant advantage of the present invention over a conventional art is that the present invention patterns an emitter material to a cathode electrode using a photolithography process or a lift-off process. In the lift-off process, the emitting compound is patterned using a sacrifice layer. Also, in another embodiment of the present invention, there is disclosed a method of easily fabricating cathodes for a triode-type field emission device using a particulate emitter material at a low process temperature. Therefore, the present invention provides a method of fabricating a cathode for a triode-type field emission device using particulate emitter that is synthesized at a high temperature of 600° C. over, as the emitter material.

18 Claims, 7 Drawing Sheets

CATHODE STRUCTURE FOR FIELD EMISSION DEVICE AND METHOD OF FABRICATING THE SAME

TECHNICAL FIELD

The invention relates to a cathode structure for a field emission device and method of fabricating the same.

BACKGROUND OF THE INVENTION

One example of the field emission device includes a field emission display (FED) being a flat panel display. The field emission display comprises the base plate having a cathode and the face plate having phosphor, which are located in parallel positions separated by a short distance (less than 2 mm) vacuum-packaged. The field emission display is a device in which electrons emitted from the cathode in the base plate collide against a phosphor on the face plate to display image by means of a cathode luminescence of the phosphor. There has been a lot of study on a flat display that will replace a conventional cathode-ray tube (CRT).

The cathode, being one of main components of the FED, is very different in an electron emission efficiency depending on a device structure, an emitter material, the shape of an emitter, etc. At present, the structure of the field emission device is mainly classified into a diode-type structure consisting of a cathode electrode and an anode electrode, and a triode-type structure consisting of a cathode electrode, a gate electrode and an anode electrode. The emitter material may include metal, silicon, diamond, diamond-like carbon, carbon nanotube, etc. Generally, metal and silicon is used as emitter material in a cathode for a triode-type field emission device while diamond or carbon nanotube, etc. is used as emitter material in a cathode for diode-type field emission device. The diode-type field emission device mainly uses film or fiber, needle, particle or powder of diamond or carbon nanotube that has a good electron emission property in a low electric field, as the emitter material. The diode-type field emission device is disadvantageous in controllability of electron emission and a low-voltage driving, but it is advantageous in that it is simple in manufacturing process and has a high reliability of electron emission, compared to a triode-type field emission device.

Referring now to FIG. 1, there is shown a schematic view illustrating a conventional cathode structure for a diode-type field emission device disclosed in U.S. Pat. No. 5,900,301 issued to Brandes, etc.

A cathode 100 comprises a cathode electrode 140 on a base plate 120, a particulate emitter 160 on the cathode electrode 140, and a bonding material 170 for bonding the particulate emitter 160 to the cathode electrode 140. A glass substrate is usually used as a material of the base plate 120. The cathode electrode 140 can be fabricated by depositing metal on the glass substrate by means of sputtering process or electron beam process, etc. and then performing a selective etching process by means of photolithography process. A cathode electrode 140 usually uses metals having good electrical conductivity, which may include Cr, Ni, Nb, etc. An emitter 160 usually uses materials having a good electron emission characteristic at a low electric field, which may include materials containing carbon as the major ingredients such as diamond, diamond-like carbon, amorphous carbon, carbon nanotube, carbon nanoparticle, etc. It is preferred that the bonding material 170 uses an electrically conductive material having a high electrical conductivity since it must has the function of electrically connecting the emitter 160 to the cathode electrode 140. The bonding material 170 must also has the function of bonding the particulate emitter 160 to the cathode electrode 140.

The U.S. Pat. No. 5,900,301 describes that Ti, graphite, Ni or its alloy can be used as the bonding material 170, and also describes that a technology for increasing the bonding force between the emitter 160 and the cathode electrode 140. As another example, U.S. Pat. No. 5,948,465 issued to Blanchet-Fincher, etc. describes a metal compound as the bonding material 170 for bonding the emitter 160 to the cathode electrode 140. The two prior arts employ $AgNO_3$ as the metal compound. One example for forming the bonding material 170 can be summarized as follows. A mixed solution is first prepared by adding 25 wt % $AgNO_3$, 3 wt % polyvinyl alcohol (PVA), 71.9 wt % distilled water and a surface active agent of 0.1 wt % and is then coated on the cathode electrode to form a mixture film. Then, the particulate emitter material is uniformly distributed in the mixture film and then a heating step is performed. During the heating step, the mixture film is burnt, by which nonmetallic components constituting the mixed solution are thus removed to leave metal only. In case of using $AgNO_3$ as the metal compound, Ag is left as the bonding material, which serves to not only electrically connect the emitter and the cathode electrode but also mechanically bond them.

FIG. 2 is a schematic view illustrating a conventional cathode 200 structure for a diode-type field emission device, disclosed in U.S. Pat. No. 5,623,180 issued to Jin, etc. The cathode 200 includes a cathode electrode 240 arranged in a stripe shape on a base plate 220, a particulate substrate 265 on the cathode electrode 240, and an emitter 260 covering the surface of the particulate substrate 265. It is mainly used an electrically insulator as material of the base plate 220. The cathode electrode 240 may be fabricated by using a good electrical conductor. A metal electrode having good electrical conductivity may be used as the material of the cathode electrode, and it is mainly used some materials having a good electron emission characteristic at a low electric field as the material of the emitter 260. Major materials of the emitter 260 may include diamond, ceramic particles such as oxide particles, nitride particles, carbon particle, etc. and semiconductor materials. As shown in FIG. 2, the emitter 260 bonded to the particulate substrate 265 may have a continuous phase that completely surrounds the particulate substrate 265. However, a plurality of the emitter particles may be discontinuously bonded to the particulate substrate 265. Some metal particles is usually used as the particulate substrate 265, and said metal may includes a metal that easily forms carbide such as Mo or a metal having high melting point. It is required that the size of the particulate substrate 265 be in the range of 0.1 to 100 micrometer in diameter, more preferably, in the range of 0.2 to 5 micrometer.

The method of fabricating the cathode electrode 240 in FIG. 2 is very different from that of fabricating the cathode electrode 140 in FIG. 1. The reason is that the cathode electrode 240 in FIG. 2 must serve to not only transfer an electrical signal to the emitter 260 but also bond the emitter 260 and the particulate substrate 265 to the cathode electrode 240. Therefore, the method of fabricating the cathode electrode 240 in FIG. 2 is similar to that of fabricating the bonding material 170 in FIG. 1. The method of fabricating the cathode electrode 240 can be summarized as follows. A slurry is produced by mixing a portion of liquid such as acetone, organic binder, metal or conductive oxide particles and particulate substrate 265 bonded with the emitters 260 by a given ratio. Metal particles may employ materials using Ag as the major ingredients and the conductive oxide particles may employ CuO particle that is easily reduced at low temperature. In a subsequent heating step, organic materials are burned out. After the heating step is finished, the particulate substrate 265 bonded to the emitter 260 and metal are left as residue. As shown in FIG. 2, the particulate substrate 265 surrounded by the emitters 260 after the heating step has a structure in which metal films are inserted discontinuously. The metal films function as the cathode electrode 240. In FIG. 2, as a portion of respective emitters 260 must have faceted edge so that it can be used as a field emission device, a surface treatment may be performed after the heating step in order to protrude the emitter 260. The surface treatment may include a chemical etching method, a mechanical polishing method, etc.

The diode-type cathodes used in the conventional field emission devices in FIGS. 1 and 2 have advantages in that the structure is simple and processes for manufacturing them are easy since they do not need a gate and a gate insulting film, unlike a conical triode-type cathode. Further, the cathode for a diode-type field emission device is high reliability because it is very robust in that the cathode is not easily broken by a sputtering effect upon emission of electrons. Also, there is rarely happened a breakdown on the gate and the gate insulating film, which becomes a big issue in the triode-type cathode. In addition, as shown in Korean Patent Application No. 99-31976, the need for a diode-type cathode as a new concept to development of an active-controlled diode-type field emission device becomes much greater.

The field emission device having the diode-type cathode has a structure in which a high electric field between the face plate and the base plate is necessary to emit electrons from the emitter. Thus, there is a limitation that the field emission device must use materials, which can easily emit electrons at a low electric field, as the material of the emitter. The materials of the emitter known so far include carbon containing materials such as diamond, diamond-like carbon, amorphous carbon, carbon nanotube, carbon nanoparticle, etc. Also, there has been reported that oxide, nitride, carbide, semiconductor materials can be used as the emitter material. However, any of them has not yet been implemented as a field emission device. The reason is that the emitter material having a good electron emission characteristic containing carbon nanotube is only synthesized at high-temperature process. Due to this reason, there are a lot of problems in selecting the base plate in order to form an emitter having a good electron emission characteristic.

In order to solve the above-mentioned problems, there was a need for a technology by which the particulate emitter material has been synthesized at a high-temperature process and the particulate emitter material is then bonded to the cathode electrode. As disclosed in several US patents (for example, U.S. Pat. No. 5,900,301, No. 5,948,465, No. 5,623,180), there is a great need of fabricating the diode-type cathode using the particulate emitter material. The key technology to be solved is the patterning of the particulate emitter material. In other words, there are a lot of problems in fabricating emitter suitable for a high-resolution field emission display device by means of conventional screen-printing method, spray coating method and dipping method.

SUMMARY OF THE INVENTION

In order to solve the above-mentioned problems in fabricating the cathode for the diode-type field emission device, the present invention proposes a method of fabricating a cathode for a field emission device using a photolithography process such as in FIG. 3. According to U.S. Pat. No. 5,064,396 issued to Spindt, the diode-type field emission device is disadvantageous in view of controllability of electron emission and low-voltage driving compared to the triode-type emission device. Another embodiment of the present invention proposes a method of fabricating a cathode for a field emission device using a lift-off process such as in FIG. 4. In a further embodiment of the present invention proposes a cathode structure for a triode-type field emission device capable of driving the field emission device at low voltage using a particulate emitter material, and a patterning process for using the particulate emitter material as a cathode.

A cathode for a field emission device proposed by the present invention has a base plate, a stripe-shaped metal electrode on the base plate, and an emitter of a particle shape or a powder shape that is bonded on the metal electrode by patterning. A glass plate, being an insulator, is used as the base plate. The cathode electrode is fabricated by forming an electrically conductive material by means of a physical vapor deposition method or a chemical vapor deposition method. It is appropriate that a metal is used as the material of the cathode electrode, and a material having a good electron emission characteristic at low electric field is used as the emitter. Representative emitter material may include materials containing carbon as the major ingredient, such as carbon nanotube, carbon nanoparticle, diamond having defects, ceramic particles such as oxide particles, nitride particles, carbon particles. Also, semiconductors are available.

A significant advantage of the present invention over the conventional art is that the present invention patterns an emitter material to a cathode electrode using photolithography process or a lift-off process. The present invention is characterized in that it forms an emitting compound in order to attach the emitter material to the cathode electrode. At this time, the emitting compound is a solution in which the emitter material is mixed with distilled water. Also, the emitting compound may include a binder for adjusting the viscosity and a small amount of additives. The viscosity and dispersion of the emitting compound can be controlled by means of the amount of the binder and additives. Also, the emitting compound is patterned using a lift-off process using a sacrifice layer after the compound film is uniformly formed on the base plate having the cathode electrode. In other words, after a sacrifice layer is formed on the cathode electrode, it is selectively exposed by ultra-violet light using a mask where is a desired pattern. Then, the sacrifice layer is selectively removed by means of a development process. Next, after the emitting compound is uniformly covered on the patterned sacrifice layer, as the emitting compound existing on the sacrifice layer is also removed by removing the sacrifice layer, patterning of the emitting compound can be thus obtained.

In the cathode for a field emission device, the emitter must exist at a desired portion. Therefore, the technology by which the particulate emitter material is bonded at a desired portion by patterning using a photolithography process disclosed in the present invention is significantly different from the conventional one. In the present invention, that is, the emitting compound formed on the cathode electrode can be exactly patterned at a desired portion since the sacrifice layer is patterned by photolithography process and the patterning of the sacrifice layer directly determines patterning of the emitting compound. As a result, the present invention can provide a technology necessary to fabricate an emitter for a high-resolution field emission device using emitter particles.

The method for fabricating a cathode for a field emission device proposed by the present invention is significantly different in the construction of the invention and its acting effect from the convention technologies. The particulate emitter is bonded to the cathode electrode by a lift-off process and patterning technology will be in detail explained by reference to FIG. 4.

BRIEF DESCRIPTION OF THE DRAWINGS

The aforementioned aspects and other features of the present invention will be explained in the following description, taken in conjunction with the accompanying drawings, wherein.

DETAILED DESCRIPTION OF THE INVENTION

Figure 1:
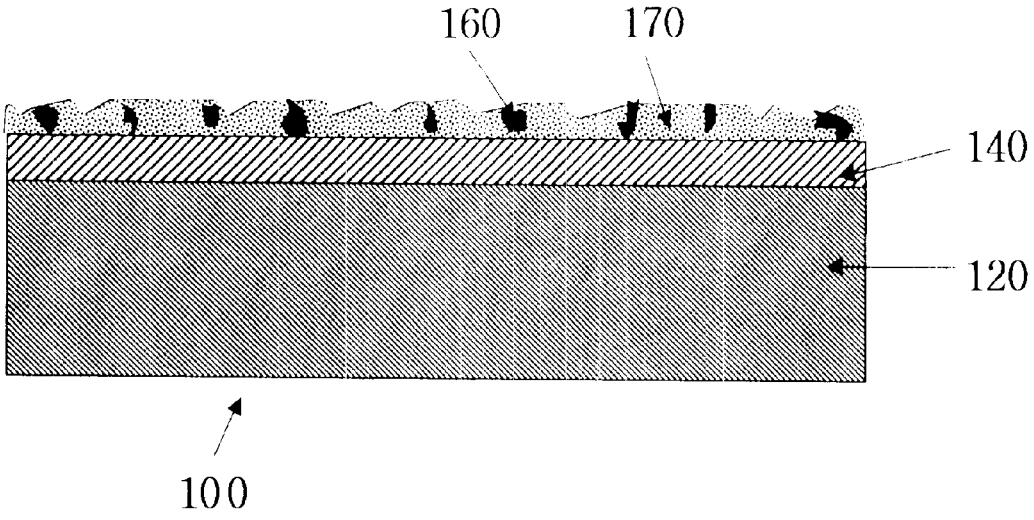
FIG. 1 (Prior Art)
FIG. 1 is a schematic view illustrating a conventional cathode structure for a diode-type field emission device.
Figure 2:
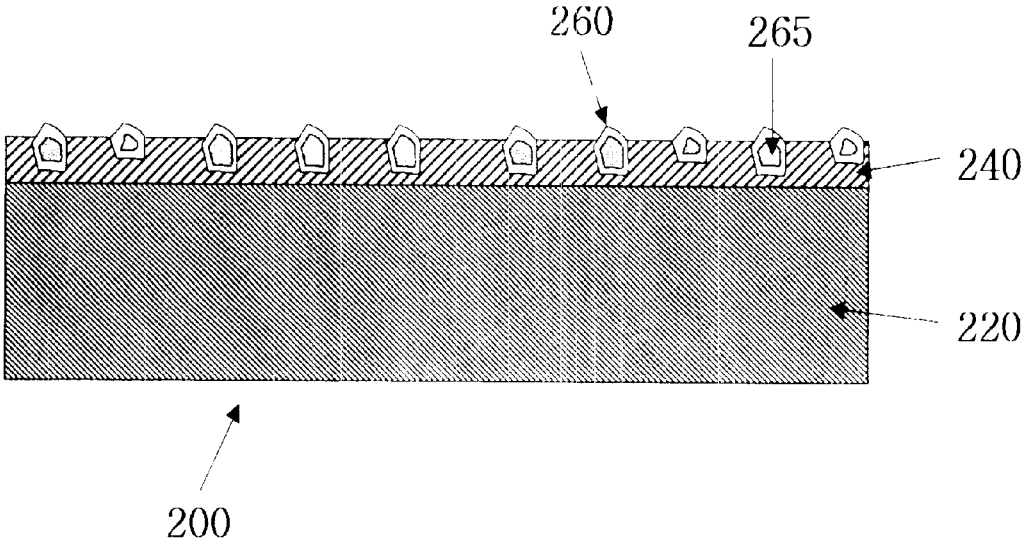
FIG. 2 (Prior Art)
FIG. 2 is a schematic view illustrating a conventional cathode structure for a diode-type field emission device.

The present invention will be described in detail by way of a preferred embodiment with reference to accompanying drawings, in which like reference numerals are used to identify the same or similar parts.

FIG. 3 is a schematic view for illustrating a process of attaching and patterning an emitter in the process of fabricating a cathode 300 for a field emission device according to the present invention. As shown in FIG. 3A, a cathode electrode 340 of a stripe-shape is formed on the base plate 320 made of an electrical insulating material such as glass. A process of patterning a particulate emitter material includes the following steps. A compound solution containing the particulate emitter material from which electrons can be easily emitted at a low electric field and a photosensitizer being a material exposed to ultra-violet light is first fabricated in the base plate 320 on which the cathode electrode 340 of a stripe shape is formed. As shown in FIG. 3B, the compound solution is then uniformly distributed on the base plate 320 including the cathode electrode to form a compound film 350. As shown in FIG. 3C, the compound film 350 is selectively exposed to ultra-violet light 390. Finally, as shown in FIG. 3D, a development process by which the compound film situates on the place where is exposed to or where is not exposed to the ultra-violet light 390 is selectively removed is performed.

Figure 3A:
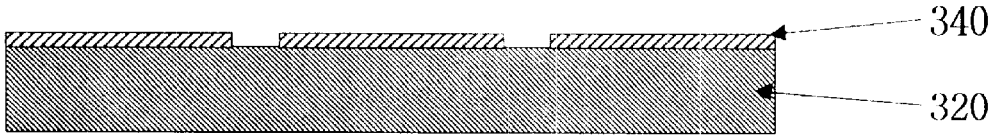
FIGS. 3A–3D are a schematic view for illustrating a photolithography process during the process of fabricating a cathode for a field emission device according to the present invention.

Meanwhile, the cathode electrode 340 of the present invention is made of a metal having a good electrical conductivity and may be also formed in a film shape having a desired thickness by means of a physical vapor deposition or a chemical vapor deposition. Though the line width of the cathode electrode 340 of the stripe in FIG. 3A is shown to be constant, the line width is not limited thereto. Patterning of the cathode electrode can be easily performed according to an etching technique using a suitable photoresist mask.

Figure 3B:
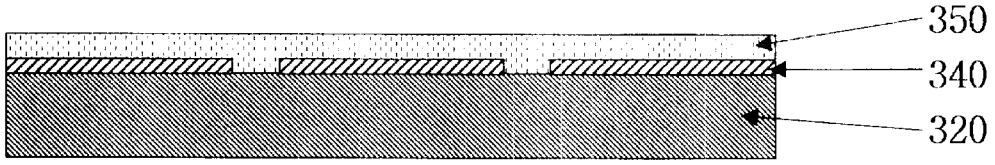

Also, in FIG. 3B, a method of forming the compound film 350 is as follows. In order to form the compound film 350, a compound solution of a colloid state is formed. The compound solution consists of an emitter material, a photosensitizer and distilled water. A binder and a surface active agent may be additionally contained. The emitter material may include a particle-shape material having a good electron emission characteristic at a low electric field. One example of the emitter material may includes materials using carbon as the major ingredient such as carbon nanotube, carbon nanoparticle, etc., diamond having defects, ceramic particles such as oxide particles, nitride particles, carbon particles, and semiconductor materials. The shape of the particulate emitter material may include a spherical shape, a lump shape, a needle shape, a plate shape, etc. but is not limited thereto. The photosensitizer constituting the compound solution may use ammonium dichromatic (ADC) and the binder may use polyvinyl alcohol (PVA), terpineol, etc. A method for forming the compound film 350 on the base plate including the cathode electrode 340 may include a spin coating method, a tape casting method, etc.

Figure 3C:
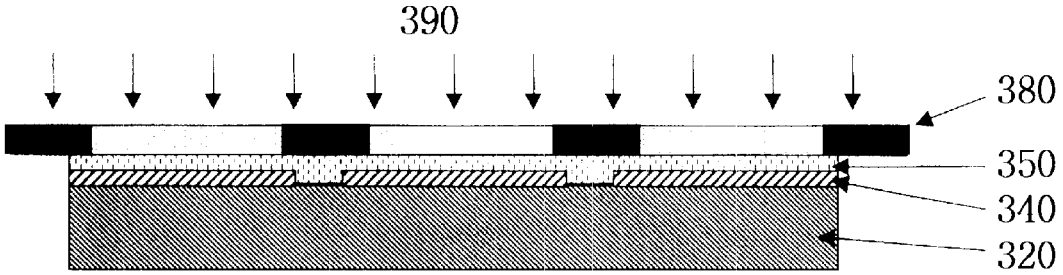

In FIG. 3C, the mask 380 has a pattern consisting of a portion in which the ultra-violet light 390 does not transmit and a portion in which the ultra-violet light 390 transmits. In case of using ammonium dichromate (ADC) as the photosensitizer, the compound film at the portion exposed to the ultra-violet light upon photolithography process reacts like a negative photoresist due to ACD being the photosensitizer. That is, upon the development process, the compound film at a portion that is exposed to the ultra-violet light is left and the compound film at a portion that is not exposed to the ultra-violet light is removed. It is preferred that the exposure of the ultra-violet light in FIG. 3C is performed with the compound film 350 being dried. The drying step of the compound film 350 is usually performed using a hot plate for 5 minutes at the temperature of 60° C. Also, it is preferred that the wavelength used upon exposure of the ultra-violet light is in the range of 280 nm–380 nm. As the pattern of the used mask 380 determines the shape of the compound film 350, it is preferred that the ultra-violet light is exposed only to pixels at a portion where the emitter will be formed.

Figure 3D:
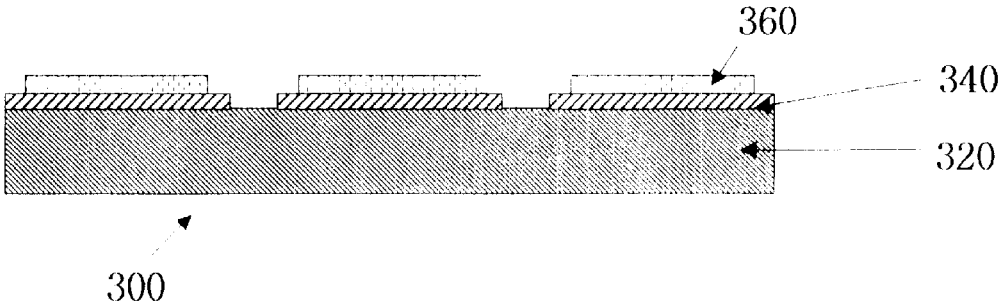
Figure 4A:
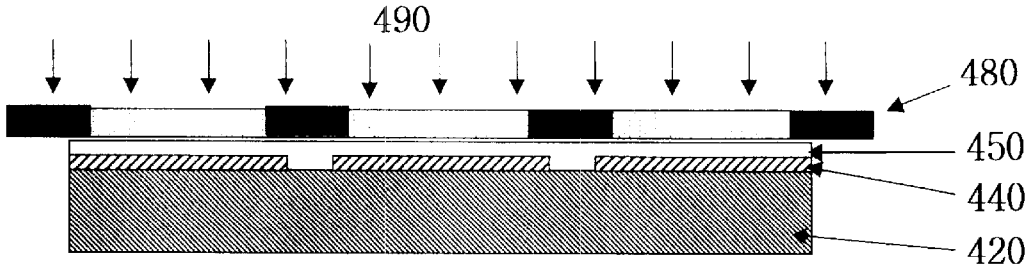
FIGS. 4A–4D are a schematic view for illustrating a lift-off process during the process of fabricating a cathode for a field emission device according to the present invention.
Figure 4B:
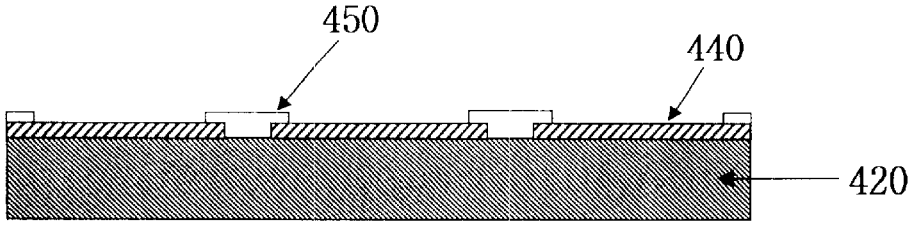
Figure 4C:
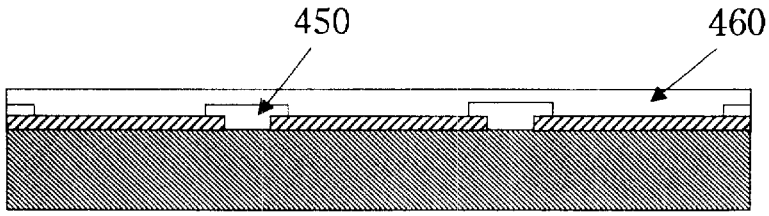
Figure 4D:
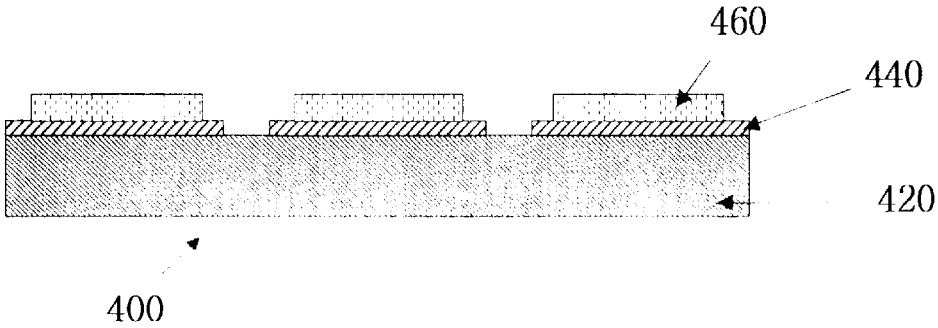

FIG. 3D is a cross-sectional view of the emitter 360, which is another name for the compound film 350 because the compound film contains a number of emitter materials patterned after the development process when the emitter is patterned by photolithography process according to the present invention. In the present invention, the development may be performed by spraying water having a given water pressure. In FIG. 4D, though only the emitter at the portion where the ultra-violet light was exposed is still left since a negative photosensitizer is used. As the compound film left after the development process contains water, binder, photosensitizer, etc., the compound film is subjected to a heating step. The reason of performing the heating step is to remove water, binder, photosensitizer, etc., being constituent elements of the compound film except for the emitter. The temperature of the heating step may vary depending on the type of the binder used when the compound solution is produced but is usually in the range of 200° C. 400° C.

As only the emitter material remains at the pixel portion after the heating step, there may occur a problem that the emitter is peeled off since the adhesive force of the cathode electrode 340 and the emitter at the pixel portion is week. According to the present invention, as one method of increasing the adhesive force of the emitter and the cathode electrode, addition of a metal compound upon fabricating of the compound solution is used. Representative metal compounds may include $Mg(NO_3)_2$ and $AgNO_3$. These metal compounds are reduced upon the heating step, thus leaving metal. They also serve as a binding agent for strongly bonding the particulate emitter 360 to the pixel portion of the cathode electrode 340. In addition, in order for the compound film to be easily formed, a small amount of a surface active agent may be added to the compound solution.

Another embodiment of the present invention provides a technology by which the particulate emitter is patterned by means of a lift-off process. FIG. 4 is a schematic view for illustrating a process of attaching and patterning an emitter in the process of fabricating a cathode for a field emission device according to the present invention. As shown in FIG. 4A, a cathode electrode 440 of a stripe shape is formed of a material having a good electrical conductivity on a base plate 420 made of an electrical insulating material such as glass. The material of the sacrifice layer 450 preferably uses polymer, more preferably photoresist. That is, after a photoresist film is formed on the base plate in which the cathode electrode is patterned using a spin coater, it is exposed to the ultra-violet light 490 using the mask 480. FIG. 4B shows a cross-sectional view of the remaining sacrifice layer 450 after the exposed sacrifice layer is developed. Then, the emitting compound 460 is uniformly coated. FIG. 4C is a cross-sectional view of the device in which the emitting compound 460 is covered on the patterned sacrifice layer 450. The method of coating the emitting compound 460 may include a tape casting method, a spin coating method, a dipping method, etc. If the sacrifice layer is removed through a given etching process, the emitting compound situating on the sacrifice layer can be removed together. FIG. 4D is a cross-sectional view of the diode-type cathode 400 having the structure in which the cathode electrode 440 is formed on the base plate 420 and the emitting compound 460 is patterned on it.

A method of fabricating a cathode for a field emission device using a particulate emitter comprises the following steps: producing an emitting compound using a particulate emitter, coating the sacrifice layer 450 on the base plate 420 on which the cathode electrode 440 of a stripe shape is formed, and then performing photolithography process as shown in FIG. 4A, patterning the sacrifice layer 450 by development process as shown in FIG. 4B, coating the emitting compound 460 on the patterned sacrifice layer 450 as shown in FIG. 4C, and patterning the emitting compound 460 by selectively removing the emitting compound 460 while selectively removing the sacrifice layer 450.

Meanwhile, the cathode electrode 440 of the present invention is made of a metal having a good electrical conductivity and may be also formed of a film shape having a desired thickness by means of a physical vapor deposition method or a chemical vapor deposition method. Though the line width of the cathode electrode 440 of the stripe shape in FIG. 4A is shown to be constant, the line width is not limited thereto. Patterning of the cathode electrode can be easily performed according to an etching technique using a suitable photoresist mask Also, in FIG. 4B, the material of the sacrifice layer 450 usually includes polymer but also may include metals such as aluminum (Al). The pattering of the sacrifice layer may use a photolithography process currently used in a semiconductor process. Through the pattering process of the photoresist using the photolithography process, patterning having a several micrometer size can be easily performed.

In FIG. 4C, a method of forming the emitting compound 460 is as follows. In order to form the emitting compound 460, a small amount of additives is added to the major ingredients including a material for the emitter and distilled water to thus form a compound of a slurry. A binder and a surface active agent as additives may be additionally added to the emitting compound 460. The emitter material may include a particle-shape material having a good electron emission characteristic at a low electric field. One example of the emitter material may includes materials using carbon as the major ingredient such as carbon nanotube, carbon nanoparticle, etc., diamond having defects, ceramic particles such as oxide particles, nitride particles, carbon particles, and semiconductor materials. The shape of the particulate emitter material may include a spherical shape, a lump shape, a needle shape, a plate shape, etc. but is not limited thereto. The additives added to the emitting compound 460 may include graphite particle, polyvinyl alcohol (PVA), terpineol, etc. A method of coating the emitting compound 460 on the patterned sacrifice layer 450 may use a tape casting method and may also use a spin coating method, a dipping method, etc. Then, the emitting compound 460 is dried on a hot plate for about 5 minutes.

FIG. 4D is a cross-sectional view of the cathode 400 from which the sacrifice layer 450 and the emitting compound 460 are selectively etched and that is then patterned by a lift-off process according to the present invention. In the present invention, removal of the sacrifice layer may be performed by dipping it into ACT1 or acetone, alcohol that is used as a stripper of the photoresist and then spraying water having a given water pressure into it. In FIG. 4D, it is preferred that the photoresist being the sacrifice layer 450 is removed using acetone, alcohol, etc. that is an organic solution, and the emitting compound 460 is removed by spraying water. In order to use the emitting compound 460 patterned by the above method as an emitter for a field emission device, water, organic binder, etc. existing in the emitting compound must be removed. Thus, the emitting compound 460 can be used after heating step at the temperature of about 300° C.

Figure 5:
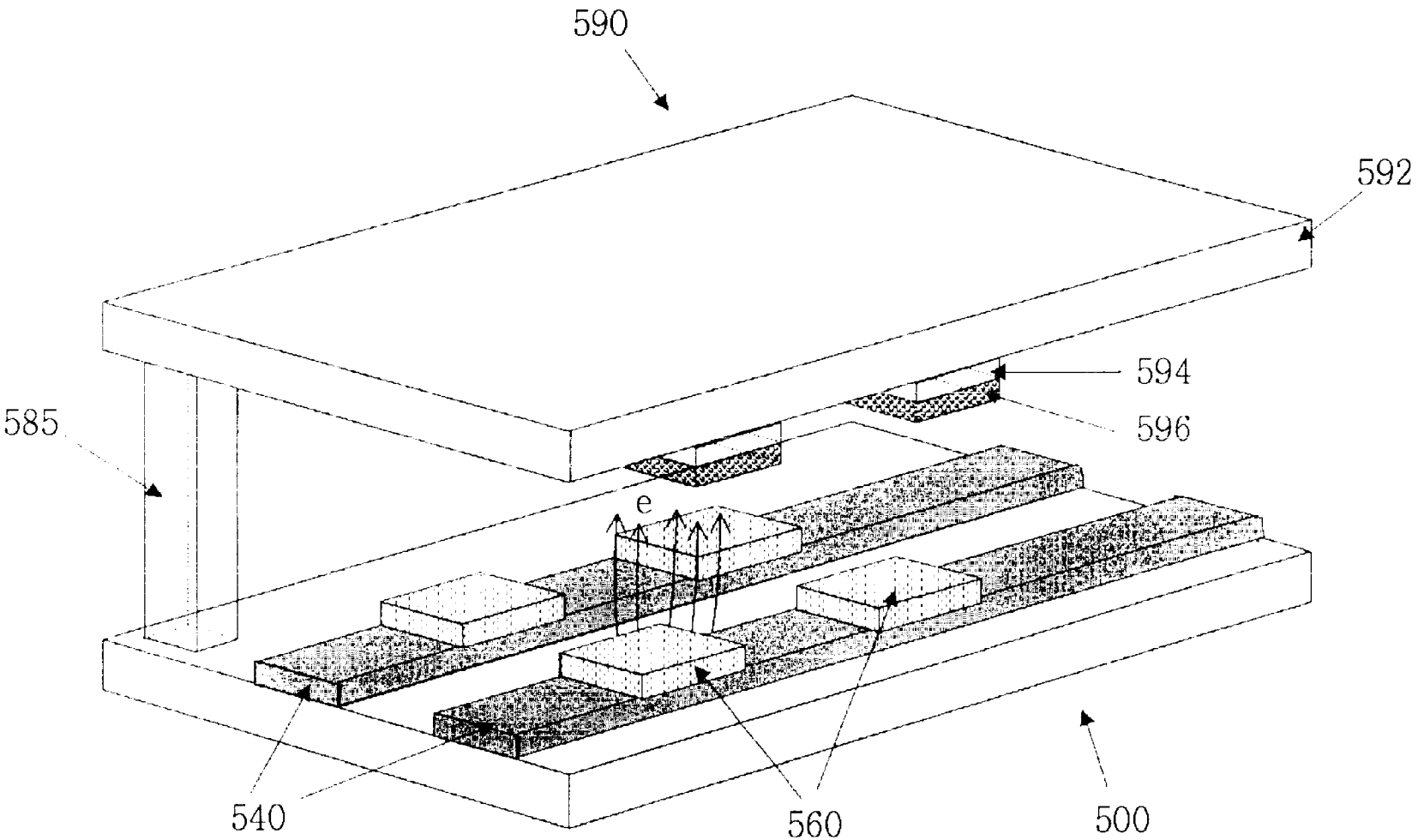
FIG. 5 is a schematic view for illustrating one example in which a cathode for a field emission device fabricated by the present invention is used in a diode-type field emission display.

FIG. 5 is a schematic view for illustrating one example in which a cathode for a field emission device fabricated by the present invention is used in a diode-type field emission display. One example in which a cathode for a field emission device 500 fabricated by the present invention is applied to a field emission display can be explained as follows. A spacer 585 is intervened between the cathode 500 and an anode 590, which are vacuum-packaged in parallel with facing each other. The anode 590 comprises an anode electrode 594 having transparent electrode arranged in a stripe shape on an face plate 592 made of a glass plate, and the face plate 592 comprising phosphors 596 of red, green and blue on a portion of the anode electrode. A cathode electrode 540 and the anode electrode 594 on the face plate are arranged to cross each other, wherein a cross region is defined as a pixel. Meanwhile, if a voltage is applied between the cathode electrode 540 and the transparent electrode being the anode electrode 594 that are crossing to each other at the pixel, an electric field is formed. If an electric field over a given value is applied, electrons are emitted from an emitting compound 560. The emitter material may use a material that easily emits electrons at the electric field of less than 10 V/um. In the present invention, the shape of the cathode electrode 540 is not limited to a stripe shape. Also, the shape, the size and the number of the emitting compound 560 are not specially limited. The patterned emitting compound 560 serves as a pixel for an emitter. It is preferred that one pixel has a plurality of sub-pixels.

Figure 6A:
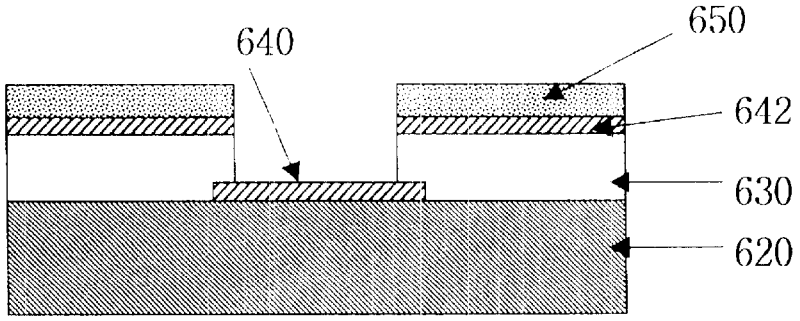
FIGS. 6A–6C are a schematic view for illustrating a process of fabricating a cathode for a triode-type field emission device according to the present invention.

FIG. 6 schematically shows a patterning process for applying the particulate emitter material to a cathode for a triode-type field emission device according to another embodiment of the present invention. As the structure until FIG. 6A can be easily fabricated using general semiconductor processes, only a rough manufacturing process will be explained below. The process includes the steps of forming a cathode electrode 640 on a glass substrate 620 and patterning the cathode electrode 640, and of coating a dielectric layer 630, a gate electrode 642 and a sacrifice layer 650, and then performing a patterning process to expose the cathode electrode 640. The fabrication process in FIG. 6A mentioned above can be well understood from U.S. Pat. No. 5,064,396 that discloses a process of fabricating a Spindt-type emitter.

Figure 6B:
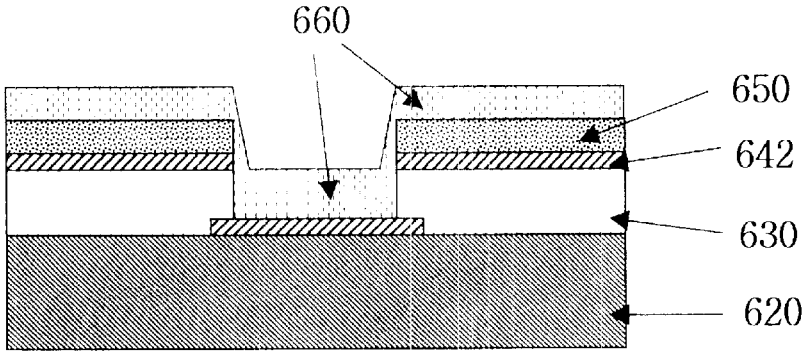

FIG. 6B is a schematic view of the emitting compound 660 coated on the patterned sacrifice layer 650 in FIG. 6A. In FIG. 6B, the method of forming the emitting compound 660 is as follows. In order to form the emitting compound 660, a small amount of additives is added to the major ingredient including a material for the emitter and distilled water to thus form a slurry. A binder and a surface active agent as additives may be additionally added to the emitting compound 660. The emitter material may include a particle-shape material having a good electron emission characteristic at a low electric field. One example of the emitter material may includes carbon containing material as the major ingredients such as carbon nanotube, carbon nanoparticle, etc., diamond having defects, ceramic particles such as oxide particles, nitride particles, carbon particles, and semiconductors. The shape of the particulate emitter material may include a spherical shape, a lump shape, a needle shape, a plate shape, etc but is not limited thereto. The additives added to the emitting compound 660 may include graphite particle, polyvinyl alcohol (PVA), terpineol, etc. The method of coating the emitting compound 660 on the patterned sacrifice layer 650 may use a tape casting method and may also use a spin coating method, a dipping method, etc. Then, the emitting compound 660 is dried on a hot plate for about 5 minutes.

Figure 6C:
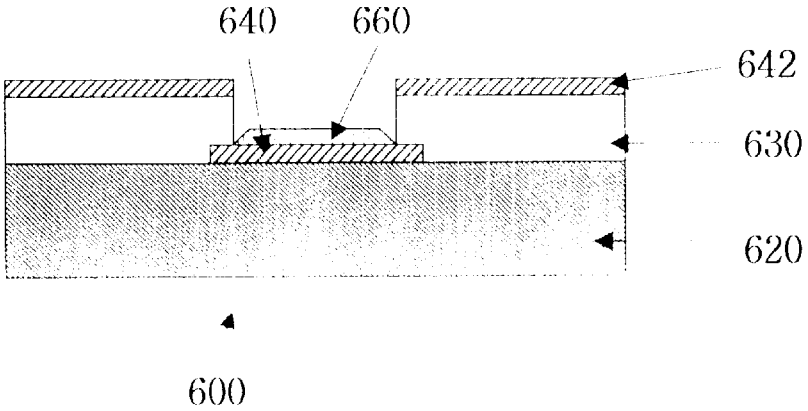

FIG. 6C is a cross-sectional view of the cathode 600 from which the sacrifice layer 650 and the emitting compound 660 are selectively removed and that is then patterned by a lift-off process. In the present invention, the material of the sacrifice layer 650 preferably uses polymer. In case of using photoresist as the sacrifice layer 650, the emitting compound can be patterned by sequentially dipping it into ACT1 or acetone, alcohol solution and distilled water. That is, in FIG. 6C, it is preferred that the photoresist being the sacrifice layer 650 is removed using acetone, alcohol, etc which are an organic solution, and the emitting compound 660 is removed by spraying water.

Though there is illustrated in FIG. 6, a method of fabricating a cathode for a triode-type field emission device by a lift-off method, a cathode for a triode-type field emission device to which a particulate emitter is bonded can be also fabricated using photolithography process. As shown in FIG. 6B, the coating of emitting compound 660 over the cathode electrode is described in the lift-off process. Because the emitting compound at a portion where the ultra-violet light exposed is not removed after photolithography process, a emitting compound pattern having a desired shape also can be produced at a desired portion.

Figure 7A:
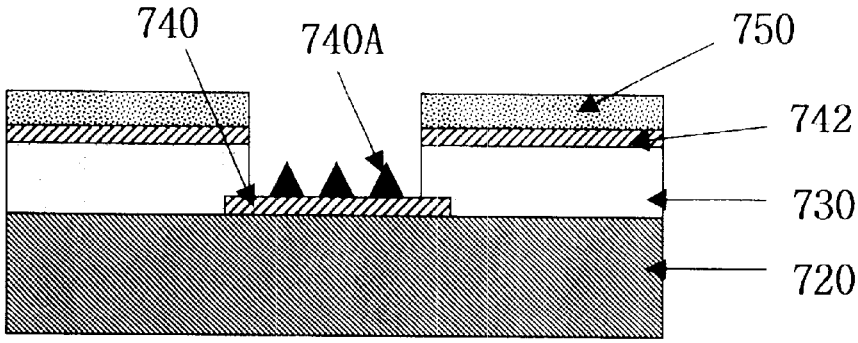
FIGS. 7A–7C are a schematic view for illustrating an improved process of fabricating a cathode for a triode-type field emission device according to the present invention.

FIG. 7 schematically shows a patterning process for applying the particulate emitter material to a cathode for a triode-type field emission device according to yet another embodiment of the present invention. The embodiment of FIG. 7 has an advantage that it has a structure in which electrons can be easily emitted at a further low electric field compared to the embodiment of FIG. 6. The structure until FIG. 7A can be easily fabricated using a general semiconductor process and its schematic fabricating process is as follows. A cathode electrode 740 is formed of an electrically conductive material on a glass plate 720. A bump 740A having sharp edge is formed on the cathode electrode 740. After coating a dielectric material 730, a gate electrode 742 and a sacrifice layer 750, patterning process is performed to expose the cathode electrode 740 on which the bump 740A is formed. The formation process in FIG. 7A is known in the process of forming the Spindt-type emitter.

Figure 7B:
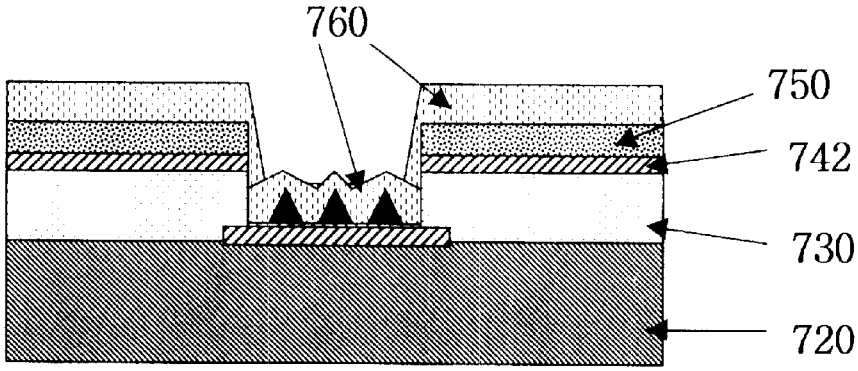
Figure 7C:
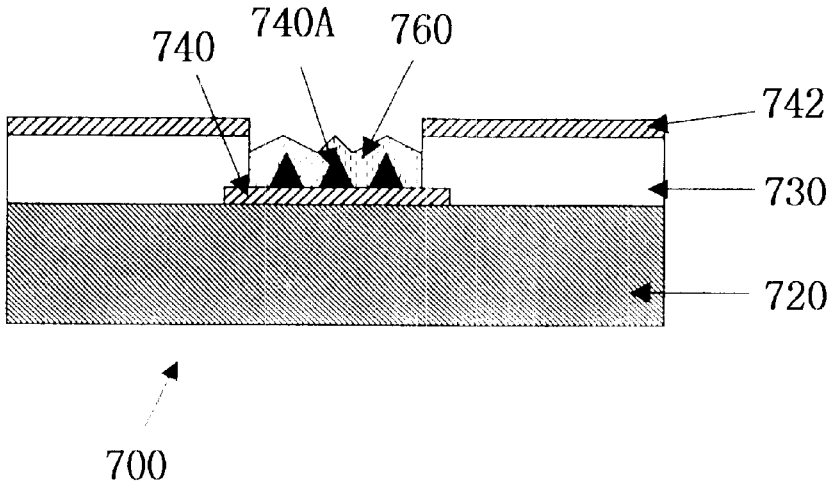

FIG. 7B is a schematic cross-sectional view in which the emitting compound 760 is coated on the sacrifice layer 750 that is patterned in FIG. 7A. In FIG. 7B, the method for forming the emitting compound 760 and the method of compounding and coating the emitting compound are similar to those in FIG. 6B. FIG. 7C schematically shows a cross-sectional view of the cathode 700 from which the sacrifice layer 750 and the emitting compound 760 are selectively removed by means of a lift-off process and that is then patterned. In the present invention, removal of the sacrifice layer 750 is similar to the method mentioned in FIG. 6C.

Figure 8A:
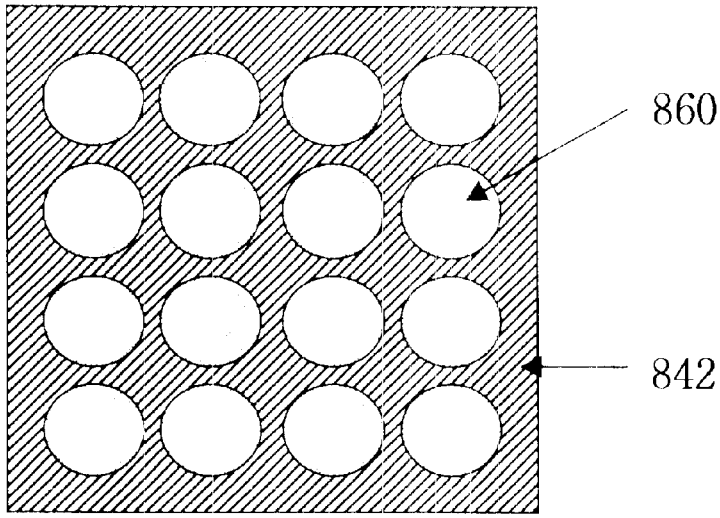
FIGS. 8A–8B are a plan view showing a plurality of sub-pixels within one pixel of a cathode for a triode-type field emission device according to the present invention.
Figure 8B:
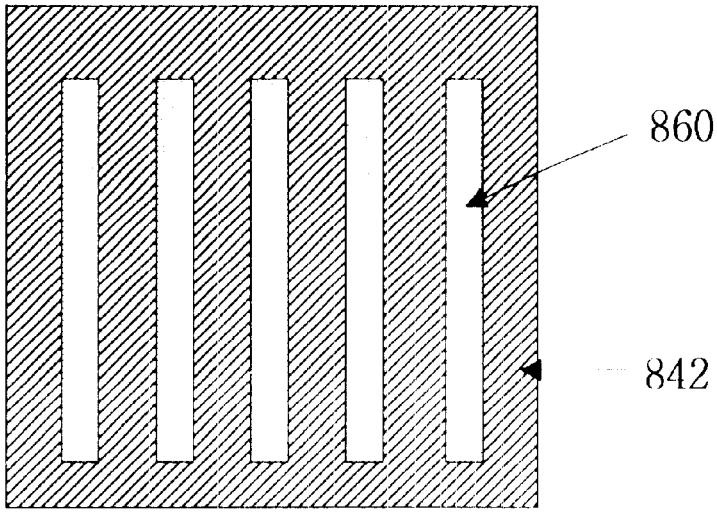

FIG. 8 is a plan view for illustrating one pixel of a cathode for a triode-type field emission device. As can be seen from FIG. 8, a plurality of emitting compounds 860 that are separated to each other in one pixel. Gate electrodes 842 situate around respective emitting compounds 860, but they are positioned in different planes. As shown in FIG. 8B, the shape of the emitting compound 860 may have a stripe shape. The size and number of the emitting compound 860 are not limited.

As mentioned above, the present invention can exactly pattern a cathode for a diode-type field emission device at a desired portion of a base plate including a cathode electrode using a particulate emitter by means of a photolithography process or a lift-off process. Therefore, the present invention has an advantage that it can bond and pattern the emitter materials having a good electron emission characteristic at a low electric field, that is synthesized by high-temperature. Also, the present invention can selectively pattern the particulate emitter having a good electron emission characteristic by means of a lift-off process without any limitation of the synthesis temperature and the shape of the plate. Therefore, the present invention can greatly contribute to selection of the base plate in the electron emission device and a larger size and a higher resolution of an electron emission device. That is, it is expected that the present invention can contribute to commercialization of a field emission display of a higher resolution and a larger size using the glass plate as the base plate.

Meanwhile, another embodiment of the present invention has explained a cathode structure for a triode-type field emission device and a method of fabricating the same using a photolithography method or a lift-off process. The cathode for a triode-type field emission device using carbon containing emitters has the same advantages of the cathode for a diode-type field emission device. In addition, the cathode for a triode-type field emission device has an advantage that it can emit electrons from the emitting compound even though a low voltage is applied between the cathode electrode and the gate electrode since it has a gate electrode that does not exist in the cathode for a diode-type field emission device. Therefore, the present invention has an advantage that it can drive a field emission device at a low gate voltage.

The present invention has been described with reference to a particular embodiment in connection with a particular application. Those having ordinary skill in the art and access to the teachings of the present invention will recognize additional modifications and applications within the scope thereof.

It is therefore intended by the appended claims to cover any and all such applications, modifications, and embodiments within the scope of the present invention.

What is claimed:

1. A method of fabricating a cathode for a field emission device using a particulate emitter, comprising the steps of:

producing an emitting compound containing the particulate emitter and a photosensitizer;

coating said emitting compound on a base plate including a cathode electrode; and selectively patterning said emitting compound by photolithography process.

2. The method of fabricating a cathode for a field emission device according to claim 1, wherein said particulate emitter is a material comprising carbon as the major ingredient.

3. The method of fabricating a cathode for a field emission device according to claim 1, wherein said particulate emitter is selected from a group composed of carbon nanotube, carbon nanoparticle, diamond having defects, ceramics particles and semiconductor materials.

4. The method of fabricating a cathode for a field emission device according to claim 1, wherein said photosensitizer is ammonium dichromatic (ADC).

5. The method of fabricating a cathode for a field emission device according to claim 1, wherein said emitting compound includes a binder.

6. The method of fabricating a cathode for a field emission device according to claim 5, wherein said binder is polyvinyl alcohol (PVA) or terpineol.

7. The method of fabricating a cathode for a field emission device according to claim 1, wherein said emitting compound includes a metal compound.

8. The method of fabricating a cathode for a field emission device according to claim 7, wherein said metal compound includes $Mg(NO_3)_2$ or $AgNO_3$.

9. A method of fabricating a cathode for a field emission device using a particulate emitter, comprising the steps of:

producing an emitting compound using a particulate emitter;

forming a sacrifice layer on a cathode electrode and then patterning said sacrifice layer;

coating said emitting compound on said patterned sacrifice layer; and selectively patterning said emitting compound by lift-off process.

10. The method of fabricating a cathode for a field emission device according to claim 9, wherein said particulate emitter is a material comprising carbon as the major ingredient.

11. The method of fabricating a cathode for a field emission device according to claim 9, wherein said particulate emitter is selected from a group composed of carbon nanotube, carbon nanoparticle, diamond having defects, ceramics particles and semiconductor materials.

12. The method of fabricating a cathode for a field emission device according to claim 9, wherein said sacrifice layer includes polymer.

13. A method of fabricating a cathode for a triode-type field emission device using a particulate emitter, said cathode including a base plate, the method comprising the steps of:

forming a cathode electrode on said base plate;

forming an insulator;

forming a gate electrode;

forming a sacrifice layer;

patterning said sacrifice layer;

coating an emitting compound on said cathode electrode and said sacrificial layer; and selectively patterning said emitting compound.

14. The method of fabricating a cathode for a triode-type field emission device according to claim 13, wherein patterning of said emitting compound is performed by means of a lift-off process.

15. The method of fabricating a cathode for a triode-type field emission device according to claim 13, wherein said cathode electrode has a bump.

16. The method of fabricating a cathode for a triode-type field emission device according to claim 13, wherein a plurality of said emitting compound is formed in one pixel.

17. The method of fabricating a cathode for a triode-type field emission device according to claim 13, wherein said particulate emitter is a material comprising carbon as the major ingredient.

18. The method of fabricating a cathode for a triode-type field emission device according to claim 13, wherein said sacrifice layer includes polymer.

* * * * *